US005263550A

United States Patent [19]

Jines et al.

[11] Patent Number: 5,263,550

[45] Date of Patent: Nov. 23, 1993

[54] RAILING FOR PORTABLE STAGING

[75] Inventors: Michael D. Jines; Dale A. Sellner, both of Owatonna, Minn.

[73] Assignee: Wenger Corporation, Owatonna, Minn.

[21] Appl. No.: 898,555

[22] Filed: Jun. 15, 1992

[51] Int. Cl.[5] ..... E04G 5/00; E04H 17/00

[52] U.S. Cl. ..... 182/113; 256/65; 256/DIG. 6; 248/231.4

[58] Field of Search ..... 248/255, 231.4, 316.7, 248/231.8, 74.2; 182/113, 106, 53; 256/DIG. 6, 65, 67, 68

[56] References Cited

U.S. PATENT DOCUMENTS

| | | | |
|---|---|---|---|
| 1,270,906 | 7/1918 | Whitney | 182/113 X |
| 1,934,000 | 11/1933 | Piccirilli | 182/113 |
| 3,747,898 | 7/1973 | Warren | 182/113 X |
| 3,756,568 | 9/1973 | Mocny et al. | 256/65 X |
| 3,867,997 | 2/1975 | Hyslop, Jr. | 182/113 |
| 3,938,619 | 2/1976 | Kurabayashi et al. | 182/113 |
| 4,620,612 | 11/1986 | Enoki et al. | 182/113 |

FOREIGN PATENT DOCUMENTS

| | | | |
|---|---|---|---|
| 2589182 | 4/1987 | France | 182/113 |
| 463976 | 8/1951 | Italy | 182/113 |
| 2127887 | 4/1984 | United Kingdom | 182/113 |

*Primary Examiner*—Karen J. Chotkowski

*Attorney, Agent, or Firm*—Patterson & Keough

[57] ABSTRACT

The present invention provides an adjustable, portable railing system for use with raised platforms or the like. The railing system broadly includes a plurality of generally horizontal rails and generally vertical uprights for supporting the rails. The uprights include a standard carrying at least one railing bracket, a platform clamp mechanism and a platform clamp operator. The elongated post-like standard has an upper crown end, a lower base end and a generally central longitudinal axis. The crown end supports the railing bracket and the base end is associated with the platform clamp mechanism. The platform clamp operator has a generally central longitudinal axis that is closely adjacent and substantially parallel to the axis of the standard.

21 Claims, 4 Drawing Sheets

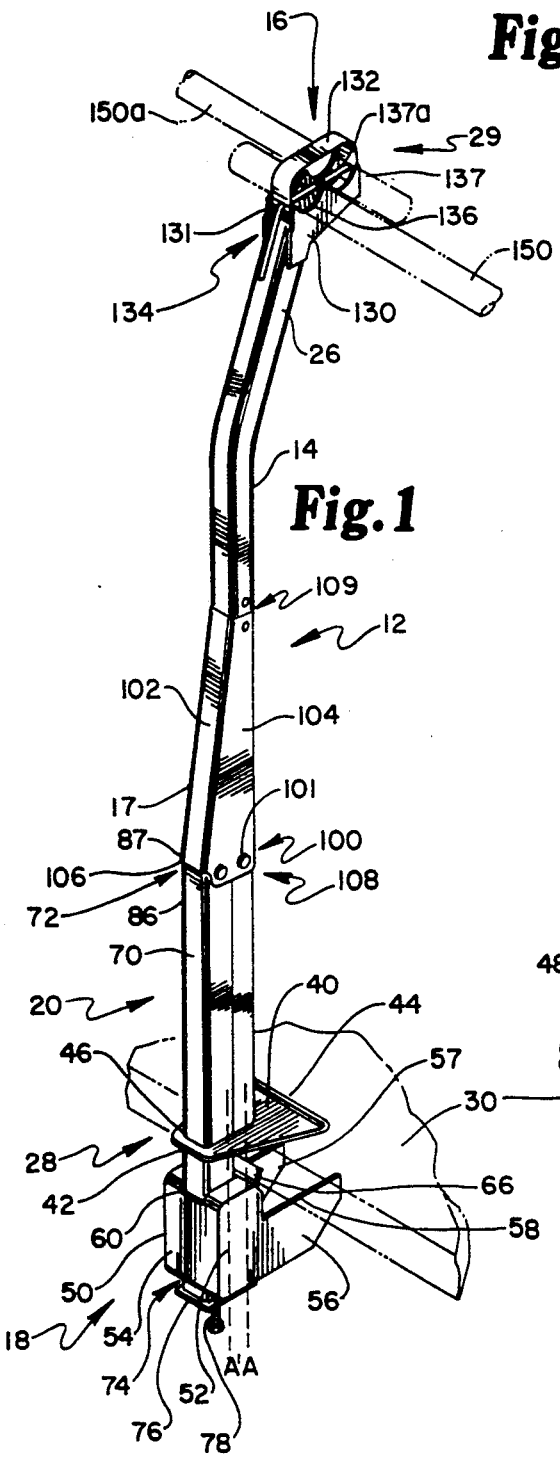
Fig. 1
Fig. 2
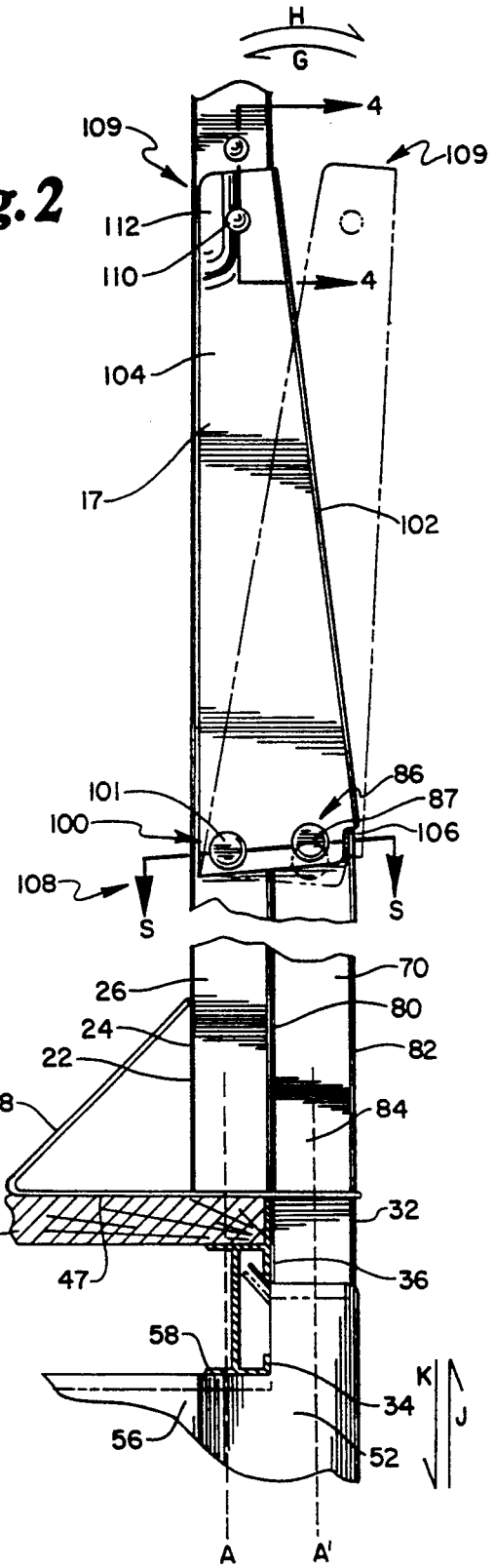

RAILING FOR PORTABLE STAGING

TECHNICAL FIELD

The present invention relates to railing systems. In particular, it relates to a railing system that can be easily attached to and removed from portable platforms, staging, risers or the like.

BACKGROUND OF INVENTION

Portable or movable railing systems are designed and used to prevent people or objects from falling off surfaces not provided with permanent barriers at the edge thereof. Such railing systems are particularly useful if they are easy and quick to set up and take down.

Portable railing systems are widely used in the construction industry, typically consisting of a plurality of vertical supports and horizontal rails. The vertical supports usually have a clamp-like base. The clamp-like base serves to secure the vertical supports at the edge of platforms, framing or flooring surfaces and usually is adjustable to fit platforms of varying thickness. The vertical supports typically carry one or more means for supporting the rope, elongated wooden members, metal tubes or the like used to form the rails.

U.S. Pat. No. 3,084,759 (to Squire) discloses a guard rail support including a stanchion, a clamping means for gripping a platform and guard rail structures. The clamping means includes a spoked nut carried by a threaded member and the clamping action is achieved by turning the spoked nut. The guard rail structures include rectangular bands for holding rails, the bands being supported by the stanchion. The rectangular bands are provided with screws having angularly offset handles. When tightened, the inner ends of the screws push the rails against the inner surface of the bands.

While the Squire patent represents an improvement in the art of securing a stanchion to floor structures or the like, and securing guard rails to a stanchion, it does not make securing and removing both stanchions and railings as quick and easy as possible. For example, a user, typically with a number of units to erect, must tighten and loosen each spoked nut and each screw, a time consuming and fatiguing process.

There are other problems associated with the Squire guard rail support. The handles of the screws used to secure the rails protrude from the rectangular bands and unintentional contact with these handles can cause personal injury, equipment damage or loosen the grip of the screw end against the rail. Another problem is that the screws will damage and split wooden rails, weakening the guard rail, reducing the number of times the rails can be reused and increasing costs. Further, the Squire device does not have a locking mechanism to insure the spoked nut does not loosen as the result of external forces such as vibrations or being hit by an object.

The clamping means disclosed in U.S. Pat. Nos. 4,669,577 (to Werner) and 3,756,568 (to Mocny et al.) are somewhat similar to the Squire clamp means in that they include a jack screw assembly, including a threaded rod and a winged nut operably coupled to the rod. Rotation of the winged nut causes the rod to travel up or down carrying clamping surfaces toward or away from a platform. Rails are inserted into square tubes (Werner patent) or brackets (Mocny et al. patent) carried by uprights and secured therein by nails, screws or the like. None of the Squire, Werner or Mocny et al. patents discloses structure for preventing the unwanted or accidental turning of the winged nut.

U.S. Pat. No. 3,747,898 (to Warren) discloses a guard rail post apparatus including a post, clamping system and rail brackets. The clamping system has a fixed jaw and a movable jaw pinned to a lever member pinned or fulcrummed to the post. The gap between the jaws can be adjusted by selectively repositioning the lever member relative to the post and tightening a threaded driving member carried by the lever member against the post. Rails laid in the rail brackets are secured therein by driving nails into the rails through holes in the brackets. U.S. Pat. No. 3,480,257 (to Bourn et al.) discloses a somewhat similar arrangement.

In the Warren and Bourn et al. designs, in order to adjust the gap between the jaws a pin must be removed, then the lever member is moved to an alternative position on the post and repinned. This is time consuming and if the pin is misplaced or dropped and not recovered the guard rail post is unworkable. Further, the Warren patent does not disclose a rail bracket to which rails can be secured and removed quickly and easily.

U.S. Pat. No. 3,938,619 (to Kurabayashi et al.) discloses a stanchion or supporting post for use with railing systems. The stanchion includes a clamp-type base, and is telescopically adjustable for setting the general distance between the upper and lower parts of the clamping means. To complete the tight mounting of the stanchion, a tool is required to turn a bolt.

U.S. Pat. No. 2,905,445 (to Blum) discloses a clamping means for mounting rails to wall brackets or posts wherein a rail is secured to the clamping means by drawing an outer cylindrical member towards an inner cylindrical member by tightening a screw that passes through the cylindrical members. Although the Blum patent represents an improvement in the art of securing rails to vertical supports, it does not adequately address the need to secure rails quickly and easily, and a tool is required to ensure the clamp is tightened adequately.

While the above-cited prior art discloses adaptations in portable railing systems that improve stability and make the components easier to set up and take down, one inadequately addressed problem is that it is time consuming to screw or nail each rail in or against a bracket or the like. It would be advantageous if rails could be secured in and removed easily and quickly from a bracket in one simple operation and without using tools. A related problem is that the rails are damaged by prior art railing systems, diminishing the safety of the railing system and increasing costs.

The prior art clamps for securing a vertical support to platform, framing or flooring surfaces are designed with tightening mechanisms, such as wing nuts, threaded screws or threaded bolts, that carry or force clamping surfaces toward each other. Such tightening mechanisms present at least two disadvantages. First, it is difficult to apply sufficient torque to obtain adequate clamping force without using a tool. Even if wings or extensions (e.g., on a nut) are provided, the length of such extensions is limited because the extensions must clear adjoining structures and, because the length is limited, an individual installing the device will be unable to exert sufficient torque to ensure a secure hold without using a tool.

Second, in railing systems that have clamps with tightening mechanisms with extensions to assist a user in tightening the clamp, clothing or equipment may be snagged on the extensions. Such contact could injure a person or damage equipment. Equally serious is the possibility that the tightness of the clamp and the integrity of the railing could be compromised. It would be advantageous to have a clamp tightening mechanism that produces sufficient clamping force with relatively little effort, yet has no exposed extensions when clamped in place. Ideally, such a tightening mechanism would be resistant to vibration and accidental blows.

Another problem in the prior art is that the clamp adjustment structures and methods used to vary the gross distance between two platform gripping surfaces involve removing and replacing a pin. In addition to the time required to perform this operation and the need to use tools to remove pins, cotter keys or the like, the pins themselves could be misplaced, making the unit inoperable. It would be advantageous to be able to adjust the distance between clamp components or gripping surfaces without disassembly and without using tools.

Clearly, there is a need for an efficient, portable railing system that can be erected quickly and easily, maximizes safety, and complements portable staging platforms and the like.

SUMMARY OF THE INVENTION

The present invention provides an adjustable, portable railing system for use with raised portable staging platforms or the like. The railing system broadly includes a plurality of generally horizontal rails and generally vertical rail uprights for supporting the rails. The rail uprights include a standard carrying at least one railing bracket, a platform clamp mechanism and a platform clamp operating means.

The elongated post-like standard has a generally central longitudinal axis, an upper crown end and a lower base end. The crown end supports the railing bracket and the base end is associated with the platform clamp mechanism. The uppermost portion of the standard angles slightly away from the axis of the standard whereby the crown end is offset relative to the base end.

The clamp mechanism adjacent the base end of the standard includes a top or upper fixed jaw and a lower movable jaw. The top jaw is fixedly attached adjacent the lower end of the standard, and the floating, movable jaw is operably connected to the operating means. When the clamp is closed, (i.e., when the jaws are relatively close together) the compressive force of the fixed and movable jaws on the staging platform holds the standard in a rigid, generally upright, vertical position. The jaws of the clamping mechanism can be modified to include tabs, serrations, projections, or the like, that will engage platform perimeter frames or cladding to further lock or secure the uprights in place.

The clamp operating means includes a generally U-shaped lever movable between closed and open positions and a tubular link member having two ends. One end of the lever is pivotally connected to the standard at a pivot joint and to the first end of the link member, which depends therefrom and is generally parallel to the standard. The other, free end of the lever is movable through a short arc into close proximity to and away from the standard. The movable jaw is connected to the link at the second link end. The link is slidably guided in an aperture in the fixed jaw so it remains closely adjacent and parallel to the standard. When the free end of the lever is close to or abutting the standard, the clamp is closed and locked. The lever is secured in the closed position by a releasable spring-loaded locking mechanism. An adjustment member for adjusting the distance between the fixed and movable jaws is carried at the extreme end of the link, under the movable jaw.

A railing bracket is attached to the uppermost end or crown of the standard, and extends generally perpendicularly therefrom. The bracket comprises a pair of spaced parallel flanges attached to opposite sides of the standard. The uppermost edge of each flange is identically relieved or scalloped in two places to receive and complement two rails. The ends of a C-shaped band, the band being as wide as the space between the flanges, are mounted between the flanges. The middle portion of the band is flat, generally above and parallel to the scalloped edges of the flanges. A bracket operator is mounted in apertures adjacent the ends of the band. The operator is a continuous rod having an elliptical portion with two flattened sides between the ends of the band, and has a handle portion at one end. The handle is outside one end of the band and at an obtuse angle to the elliptical portion.

The present invention also encompasses a modified form of the bracket wherein the bracket operator is replaced by a plurality of resilient, deformable wafers sandwiched between the flanges. The wafers have relieved areas or scallops that substantially conform to the rails, but are slightly smaller and have lip edges through which the rails must be forced.

In using the railing system of the present invention, a standard is positioned at an edge of a platform with the underside of the upper jaw resting on the upper platform surface. With the lever of the clamp operating means, and thus the clamp, in the open position, i.e., with the free end of the lever spaced from the standard, the adjustment means associated with the clamp, specifically, with the link member, is used to adjust the gripping space between the jaws approximately to the thickness of the platform. The clamp operating lever is then moved to its closed position abutting the standard, pulling the movable jaw upwardly into contact with the underside of the platform, and fixing the standard in place. Rails are slid into the railing bracket and the bracket operator is closed to lock them in the bracket.

It is an object of the present invention to provide a railing system for use with portable platforms, staging, risers, or the like.

It is another object of the present invention to provide a portable railing system including a substantially rigid, strong upright carrying a base clamp and clamp operating mechanism whereby the upright can be removably mounted on a platform.

Yet another object of the present invention is to provide a railing system including an upright or standard carrying a platform gripping base clamp and a clamp operating mechanism, wherein base clamp includes a fixed jaw and a movable jaw and wherein the gripping space between the jaws is adjustable.

Still another object of the present invention is to provide an upright baluster or standard for supporting at least one generally horizontal, elongated rail, wherein the standard is removably mounted at the edge of a platform or the like and carries a rail receiving bracket adjacent its uppermost end.

A further object of the present invention is to provide an effective rail barrier for portable staging or the like that maximizes safety and complements the staging, yet is easily installed, removed, transported, and stored.

One of the features of the present invention is that the lower, movable jaw of the platform clamp carried by the standard is operably linked to a relatively long clamp operating lever pivotally connected to the standard and generating significant mechanical advantage, whereby substantial gripping force can be applied to the platform with relatively little effort by the individual clamping the standard in place. An associated advantage of the present invention is that the clamp operating lever abuts, rather than extends away from, the standard when the platform clamp is closed.

Another feature of the present invention is that the rail bracket and the bracket operating means enable the user to insert rail members quickly and easily into the brackets, yet secure the rails in place simply by turning the bracket operator handle through a quarter turn. An advantage associated with the bracket operator is that when the rails are locked in the brackets, the operator handle is abutting or immediately adjacent to the standard.

Other features and advantages of the railing system of the present invention include that it is lightweight and can be adapted to many staging configurations, that one or more rail brackets can be attached to a single standard, that the platform clamp operating lever is held closed by a releasable safety latch means, and that installation and removal of, and all adjustments to, the system are accomplished without removing and replacing discrete pins or the like, and without using tools.

Other objects and advantages of the railing system of the present invention will be understood with reference to the following specification and appended drawings and claims.

BRIEF DESCRIPTION OF THE DRAWINGS

FIG. 1 is a perspective view of the present invention.

FIG. 2 is a fragmentary side elevation view of the present invention, depicting the base clamp mechanism and operating lever.

DETAILED DESCRIPTION OF THE PREFERRED EMBODIMENT

Figure 3:
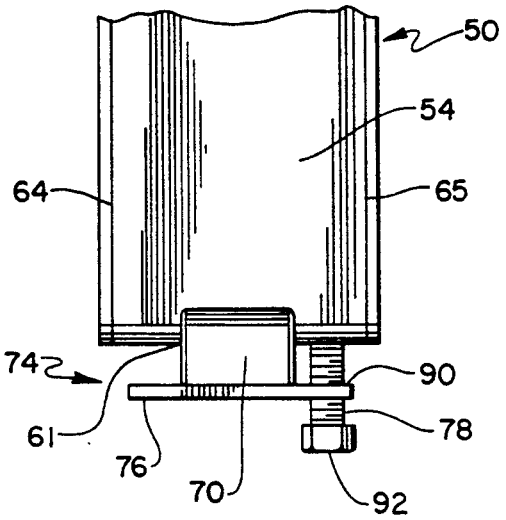
FIG. 3 is a fragmentary rear elevation view, depicting the bottom jaw and adjustment member.

Referring to FIG. 1, the rail system 12 of the present invention includes a standard 14, a rail bracket assembly 16, a base platform clamp assembly 18 and an operating linkage 20. The system broadly also may include rail members 150 formed of elongated materials such as metal tubes, wood timbers, rope or the like.

The standard 14 and the operating linkage 20 each have a generally central longitudinal axis depicted at lines A, A', respectively, and the rail system 12 is designed so that the axes A, A' are generally parallel and close together.

The standard 14 is a generally rectangular, rigid, unitary member having front, back and lateral sides, 22, 24, and 26, 27, respectively. The designation of front, back and lateral reflect the position of the sides 22, 24, 26, 27 of the standard 14 relative to a stage platform panel 30 when the standard 14 is attached thereto as depicted in FIG. 2. The back side 24 of the standard 14 is generally coplanar with the metal perimeter molding 32 of the platform panel 30 and the front 22 and lateral sides 26, 27 are supported over the platform 30. When secured to the stage platform panel 30, the standard 14 is generally vertical from its base end 28 to a point generally adjacent to or above midway between the base end 28 and crown end 29. In the preferred embodiment, at a point generally adjacent the crown end 29, the standard 14 is slightly angled whereby the crown end 29 of the standard 14 is offset from the base end 28 and over the stage platform panel 30.

The base clamp assembly 18 includes a top jaw 40 and a bottom jaw 50. The immovable top jaw 40 is a generally trapezoidally shaped plate rigidly attached to and extending outwardly from all sides of the standard 14. The top jaw 40 is generally adjacent to, but spaced from the base end 28 of the standard 14. The jaw 40 has a blunt apex 42 and a base 44. A generally rectangular aperture 46 is adjacent the back side 24 of the standard 14 in the blunt apex area 42 of the top jaw 40. As depicted in FIG. 2, in the preferred embodiment the forward or base edge 44 of the top jaw 40 bends back over itself forming a continuous brace flange 48 that extends toward and is rigidly attached to the front side 22 of the standard 14. The underside or inside surface 49 of the top jaw 40 is the upper, platform contacting or biting, gripping surface for the base clamp assembly 18. FIG. 1 depicts a modified form of the top jaw 40 without a flange 48.

The bottom jaw 50 consists of two L-shaped cheeks 52, 53 rigidly attached to a C-shaped housing 54. The cheeks 52, 53 are spaced and parallel, and each includes a tine 56, 57. The tines 56, 57 provide the platform contacting, lower gripping surface 58, 59 for contacting the underside of the platform or perimeter base 34. As depicted in FIGS. 1 and 3, the C-shaped housing 54 has generally rectangular upper and lower apertures 60, 61, respectively, for operably connecting the bottom jaw 50 to the operating linkage 20. Referring to FIGS. 1 and 3, the apertures 60, 61 are located substantially equidistantly from the outside edges 64, 65 of the housing 54. Referring to FIG. 1, an angled trap tab 66 protrudes from inside the upper end of the housing 54, at the edge thereof nearest the gripping surface of the top jaw 40.

Figure 5:
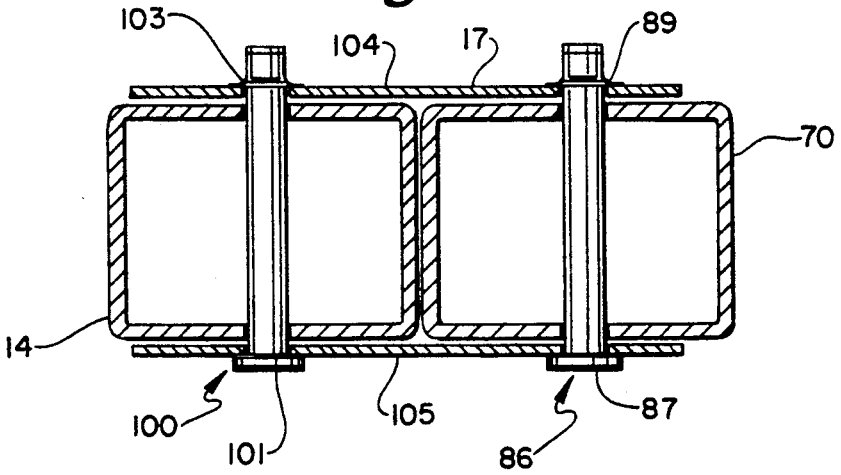
FIG. 5 is a sectional top plan view taken along line 5—5 of FIG. 2, and depicts the jaw link member, the standard and the lever member.

The operating linkage 20 includes a jaw link member 70 having a lever end 72, a free end 74, and a generally central longitudinal axis A'. The linkage 20 also includes the generally rectangular, flat adjustment sole plate 76 and a bite adjustment member 78. Referring to FIG. 2, the jaw link 70 is a generally rectangular, rigid, unitary member having front, back and lateral sides, 80, 82, and 84, 85, respectively, being substantially similar to the standard 14 in cross-section, as seen in FIG. 5, but relatively shorter, approximately one-third the length of the standard 14, as seen in FIG. 1. The axes A', A of the jaw link 70 and the standard 14, respectively, are parallel and the front side 80 of the jaw link 70 abuts the back side 24 of the standard 14. The jaw link 70 is pivotally connected to the lever 17 at a jaw link joint 86 and extends immediately adjacent and along the standard 14 through the aperture 46 in the top jaw 40. The jaw link joint 86 is formed by a pin 87 received in apertures adjacent the lever end 72 of the jaw link and the lever 17, being secured in place with a press-on lockwasher 89. The link 70 extends through the apertures 60, 61 in the bottom jaw 50 and terminates at its free end 74 where the adjustment sole plate 76 is fixedly carried. The link 70 operably connects the lever 17 with the bottom jaw 50.

Referring to FIG. 3, the adjustment sole plate 76 has a threaded aperture 90 adjacent one corner for receiving the threaded bite adjustment member 78. One end of the bite adjustment member 78 contacts the bottom or underside of the bottom jaw 50. The other end of the member 78 has a hexagonal head 92 that provides a gripping surface for facilitating turning the bite adjustment member 78.

With reference to FIGS. 1, 2 and 5, the platform clamp operating lever 17 is slightly shorter than the jaw link 70 and is pivotally connected to the standard 14 at a fulcrum joint 100, generally horizontally coplanar with and adjacent to the jaw link joint 86. The fulcrum joint 100 is formed by a pin 101 received in apertures in the standard 14 and the lever 17, being secured in place with a press-on lockwasher 103. The lever 17 extends upwardly from the fulcrum joint 100 toward the crown end 29 of the standard 14. The lever 17 is a generally U-shaped unitary member having a spine 102 and a pair of parallel, triangularly-shaped side shoulder flanges, 104, 105.

The spine 102 has a relieved area or notch 106 adjacent its lower end 108. Referring to FIG. 2, the shoulders 104, 105 substantially envelop and abut the rear and lateral sides 24 and 26, 27, respectively, of the standard 14 when the lever 17 is in its closed position, the lower and upper ends 108, 109 of the spine 102 being substantially flush with the standard 70 and jaw link 14, respectively. The notch 106 allows the upper, free end 109 of the lever 17 to pivot away from the standard 14 to its open position, depicted in phantom.

With continued reference to FIG. 2, a pin latch hole 110 is located in one shoulder 104 at the upper end 109 of the lever 17. A flared, handgrip area 112 for receiving a user's fingers or thumb is at the upper end 109 of the lever 17 adjacent to the latch hole 110.

Figure 4:
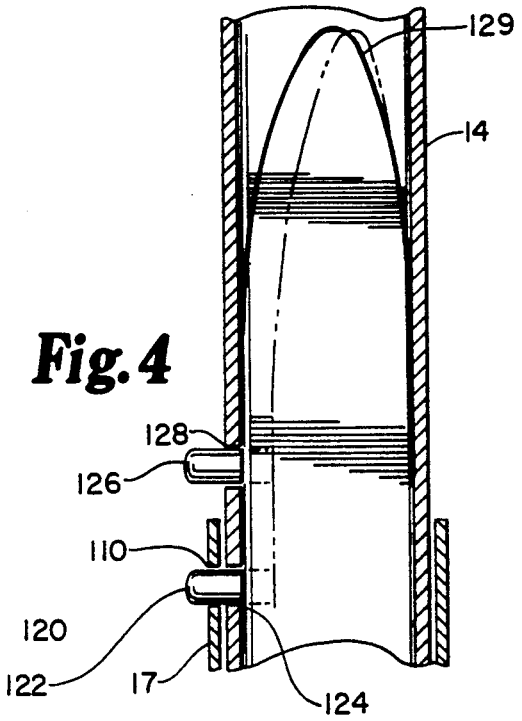
FIG. 4 is a fragmentary sectional view taken along line 4—4 of FIG. 2, and depicts the latch pin mechanism of the present invention.

Referring to FIG. 4, the standard 14 carries a lock 120 for the lever 17. The lock 120 includes a latch pin 122 that protrudes through an aperture 124 in the standard 14 and the latch pin hole 110. Adjacent to and vertically in-line with the latch pin 122 is a latch operating button 126. The latch button 126 protrudes through a hole 128 in the standard 14 just beyond the end of the lever 17.

Both the latch pin 122 and latch button 126 are attached to a springsteel leafspring 129 mounted within the interior of the standard 14. The leafspring 129 is of sufficient strength to bias both the latch pin 122 and latch button 126 outwardly through their respective holes 124, 110, 128 but is sufficiently supple so as to allow the user to depress the latch button 126 with a finger, whereby the spring 129 carries or retracts the latch pin 122 out of the latch hole 110 releasing the lever 17 for movement.

Referring to FIG. 1, the rail bracket assembly 16 includes a pair of parallel side flanges 130, 131, an overstrap band 132 and rod-like clamp operator 134. Each flange 130, 131 is rigidly attached to and generally coplanar with one side 26, 27 of the standard 14 adjacent the crown end 29 of the standard 14, and each has two arcuate scalloped grooves or rail nests 136, 137, and **136*a*, 137*a* along its upper edge. The flanges 130, 131 extend generally perpendicularly outwardly relative to the front side 22 of the standard 14, the grooves 136, 137, and 136*a*, 137*a* forming a nesting surface to complement the shape of the rails 150**.

Figure 7B:
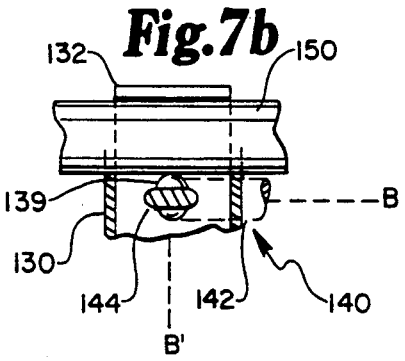
FIG. 7*b* is a cross section taken along line 7*b*—7*b* of FIG. 7, and depicts the locking mechanism used in association with the railing bracket in an unlocked or open position.
Figure 7:
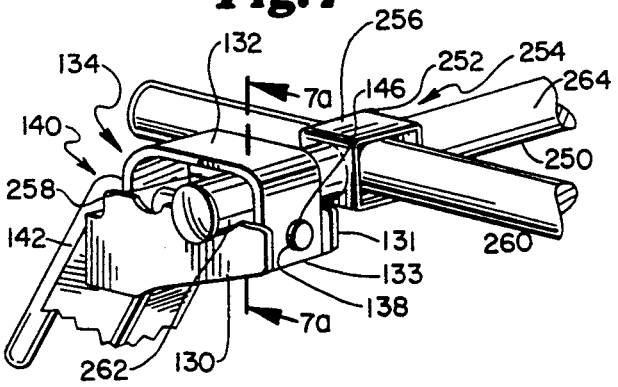
FIG. 7 is a fragmentary perspective view of a rail corner assembly.

Referring to FIG. 7, the overstrap band 132 is a solid, unitary, generally C-shaped band rigidly attached along its side edges adjacent its ends 133, 135 to the inside surfaces of the flanges 130, 131. The flanges 130, 131 and the overstrap 132 define an enclosed rail receiving area. The overstrap 132 has an aperture 138, 139 at each end generally midway between its side edges.

Figure 7A:
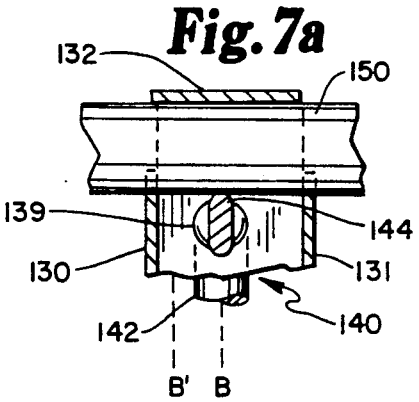
FIG. 7*a* is a cross section taken along line 7*a*—7*a* of FIG. 7, and depicts the locking mechanism used in association with the railing bracket.

As depicted in FIGS. 1, 7, **7*a* and 7*b*, a clamp operator 134 comprising a trunnion rod 140 having a handle 142 and an elliptical cam area 144 is received in and supported by the two apertures 138, 139 in the overstrap 132, being secured in place with a press-on lockwasher 146. The handle 142 is angled so that the axis B of the handle 142 and the axis B' of the standard 14 at the crown end 29 are substantially parallel to each other when the trunnion rod 140 is rotated to the point where the distance between the inside surface of the overstrap 132 and the cam area 144 is most greatly reduced, as depicted in FIG. 7*a*. This is the locked position. As depicted in FIG. 7*b*, when the trunnion rod 140 is turned to the point where the distance between the inside surface of the overstrap 132 and the cam area 144 is the greatest, the axis B of the handle 142 is substantially perpendicular to the axis B' of the standard 14 at the crown end 29**.

Figure 6:
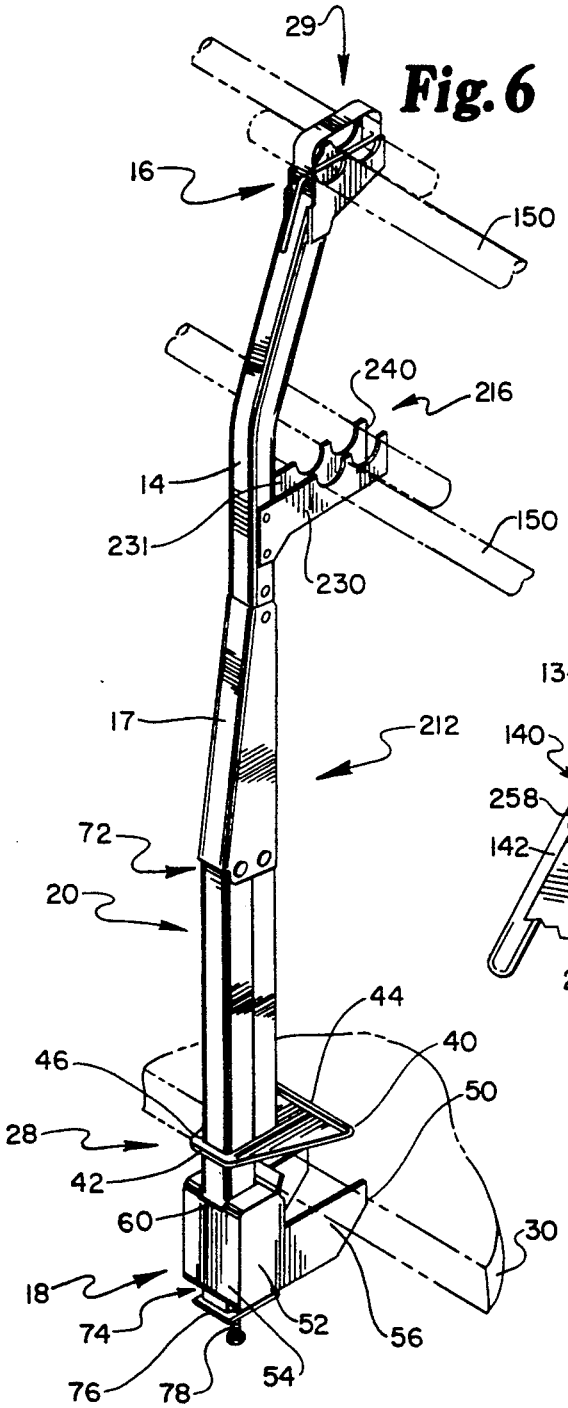
FIG. 6 is a perspective view of an alternative embodiment of the present invention with a second railing bracket mount in use.
Figure 8:
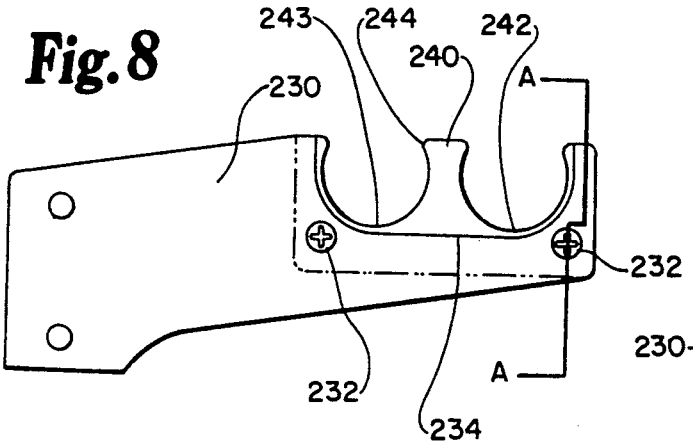
FIG. 8 is a fragmentary side elevation view, depicting the second or middle railing bracket for use with a multiple railing embodiment of the present invention.
Figure 8A:
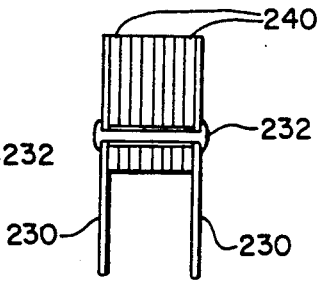
FIG. 8*a* is a cross section taken along line 8*a*—8*a* of FIG. 8.

A modified dual rail form 212 of the present invention is depicted in FIGS. 6, 8 and **8*a*. A modified, second rail bracket assembly 216 includes two side plate flanges 230, 231 and eight resilient wedge wafers 240. The flanges 230, 231 are attached to the standard 14 and the wafers 240 are mounted between the flanges and secured by screws 232. The flanges have relieved upper edges 234, 235 and the grooves, scallops or arcuate recesses 242, 243 of the wafers 240 have lips 244. The recesses 242, 243 of the wafers 240 are sufficiently deep so that when a rail 150 is pressed past the lips 244 into a recess 242, the scalloped recess 242 extends around over one-half the circumference of a rail 150**.

FIG. 6 depicts a modified corner rail 250 incorporating a box frame 252 adjacent the junction end 254 of the corner rail 250 used to construct corner junctions. The box frame 252 is a generally square member having two horizontal sides 256, 257, two vertical sides 258, 259, and two open ends 260, 261. The designation of horizontal and vertical reflect the position of the box frame sides 256, 257, 258, 259 relative to a horizontal stage platform 30 when the modified corner rail 250 is held in a rail bracket assembly 16 of a standard 14 attached thereto. The junction end 254 of the corner rail 250 includes a stub rail end 262 rigidly attached to one vertical side 259. The two open ends 260,261 define a rail receiving area slightly larger than the dimensions of a rail 150.

In use, before placing the rail system 12 on a staging platform panel 30, the adjustment member 78 located in the adjustment plate 76 is turned, backing the adjustment member 78 away from the bottom jaw 50 until the bottom jaw 50 comes to rest on the adjustment plate 76, providing maximum space between the jaws 40, 50. The adjustment member 78 will still be retained in the threaded aperture 90 in the adjustment plate 76.

Referring to FIG. 2 and 4, the platform clamp 18 is opened by depressing the latch button 126 in the direction of arrow N to free the latch pin 122 from the lever 17. The free end 109 of the lever 17 can then be pulled away from the standard 14 until fully opened (as depicted in phantom in FIG. 2).

Once the platform clamp 18 is open, the rail system 12, specifically, the gripping surface 49 of the top jaw 40, is placed on the surface of the stage platform panel 30 and the rail system 12 is pushed inwardly until the perimeter frame molding 32 and the metal perimeter base 34 contact the jaw link 70 and bottom jaw 50, respectively. The adjustment member 78 is turned to move the bottom jaw 50 toward the perimeter base 34 until the platform contacting surfaces 58, 59 of the tines 56, 57 are about one-half inch from the platform metal perimeter base 34.

Next, the lever 17 is moved toward the standard 14 (in the direction of arrow G in FIG. 2), drawing the bottom jaw 50 up toward the top jaw 40, the direction of movement of the bottom jaw 50 being depicted by arrow J, thereby pressing the stage panel 30 between the two jaws 40, 50. In addition to the compressive force exerted by the jaws 40, 50, the trap tab 66 engages the depending skirt 36 to assist in firmly securing the standard 14 to the stage platform panel 30.

The lever 17 is pushed or moved toward the standard 14 until the latch pin 122 engages the latch hole 110. The flared area 112 provides a leading edge that assists driving the latch pin 122 into the standard 14. When the lever 17 reaches its fully closed position, the spring 129 drives the latch pin 122 into the latch hole 110 (in the direction of arrow O in FIG. 4), thereby locking the lever 17 securely to the standard 14.

After the rail systems 12 have been secured to the panels 30 as outlined above, rails 150 can be inserted in the bracket assemblies 16. First, the clamp handle 142 is turned to rotate the cam area 144 of the trunnion rod 140 to the open position depicted in FIG. 7*b*. Referring to FIG. 1, a rail 150 is inserted and rests in one set of the scalloped rail nests 136, 136*a*. Another rail 150*a*, extending 180° away from the first rail 150, is placed in the second set of rail nests 137, 137*a*. The second ends of the two rails 150, 150*a* are similarly supported in adjacent brackets 16. Ideally, the rails 150 should be positioned with their ends extending equidistantly through the bracket assemblies 16.

After the rails 150 have been placed, the handle 142 is turned to rotate the trunnion rod 140 bringing the rounded portion of the elliptical cam area 144 into contact with the lower surface of the rail 150 (as depicted in FIG. 7*a*) and pressing the rails 150 against the overstrap 132, binding them firmly in place. An advantage of the present invention is that a user is able to secure the rails 150 within the brackets 16 by simply moving the handle 142 in a short arc with one relatively short continuous hand movement.

Figure 9:
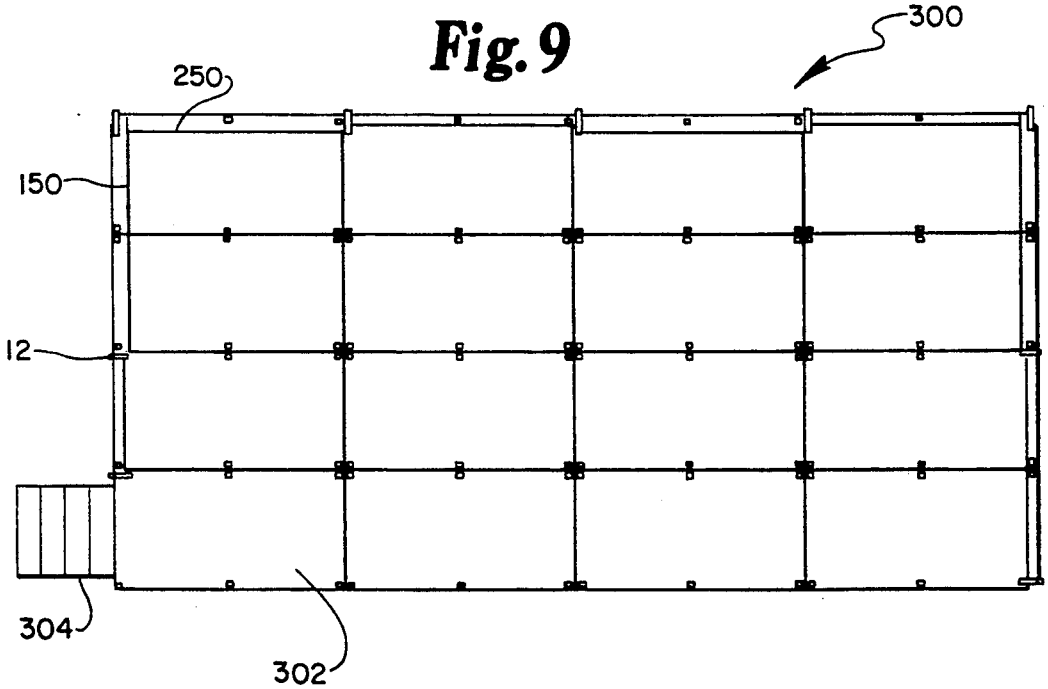
FIG. 9 is a top plan view of a false flooring platform with the present invention erected along three sides of the platform.
Figure 10:
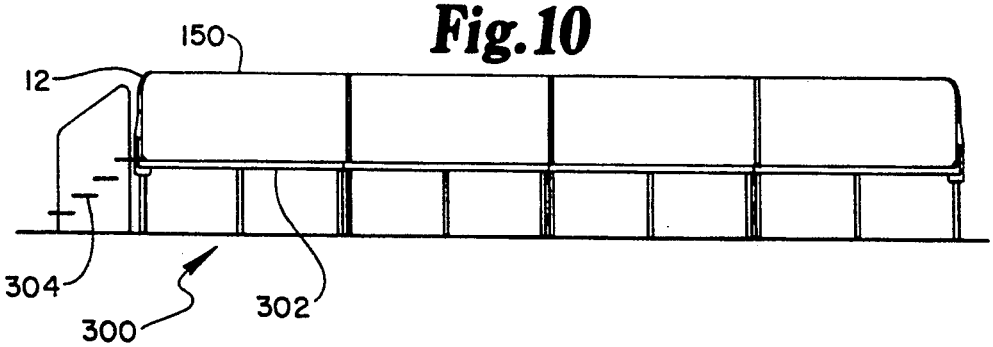
FIG. 10 is a front elevational view of a false floor platform with the present invention erected along three sides of the platform.

FIGS. 9 and 10 are pictorial views of a false floor or stage platform 300, constructed from panels 302, with the portable railing system 12 of the present invention erected along the sides of the platform 300. FIG. 9 is a top plan view of the staging platform 300 with steps 304, the portable railing system 12 being placed along three sides of the staging platform 300, and rails 150 and corner rails 250 interconnecting the standards 14 to provide a continuous edge barrier. FIG. 10 is a front elevational view of the platform 300 and portable railing system 12 shown in FIG. 9. It should be understood that FIG. 9 and 10 are presented for illustrative purposes, depicting one example of a platform or the like with which the present invention may be used.

In the preferred embodiment, the components of the present invention, including the standards 14, the railing brackets 16, the platform clamp assembly 18 and the operating means 20 may be formed from suitable gauge steel. The wafers 240 for the second bracket assembly 216 may be made of ABS plastic. Typical rails 150 have a 1.250 inch outside diameter and are formed from 14 gauge tubing steel. Other appropriate materials, such as aluminum or plastic, may be used for any of the components.

The length, diameter and shape of the rails 150 can vary, but a preferred length is from three to eight feet. The spacing between the standards 14 can be varied, but typically the rails 150 will overlap at each standard 14 to form a continuously extending barrier at a platform edge. One or more modified rail bracket assembly 216, or an equivalent thereof, may be located anywhere along the length of the standard 14 as long as the operation of the lever 17 is not impaired. At lower places on the standard 14, the second rail bracket 216 supports rails 150 acting as a lower chair stop.

Although a description of the preferred embodiment has been presented, it is contemplated that various changes, including those mentioned above, could be made without deviating from the spirit of the present invention. It is therefore desired that the present embodiment be considered in all respects as illustrative, not restrictive, and that reference be made to the appended claims rather than to the foregoing description to indicate the scope of the invention.

What is claimed:

1. A movable railing support for supporting rails comprising:

a standard having a first end, a second end, and a generally central longitudinal axis and carrying a fixed jaw adjacent said second end, a bracket assembly adjacent said first end and an operating means including a movable bottom jaw for securing said railing support to an edge of a flooring surface, said operating means including:

a lever pivotally connected to said standard, and a link means, said link means connecting said lever and bottom jaw for communicating pivotal movement of said lever to said bottom jaw, said link means having a generally central longitudinal axis generally parallel to the axis of said standard.

2. The standard according to claim 1, wherein said bracket assembly comprises a relieved rail nest, a band operably connected to said rail nest, whereby said rail nest and said band form a rail receiving space, and a bracket operator means for urging said rails against said band.

3. The standard according to claim 2, wherein said bracket operator means is generally rod-shaped, having a generally elliptical rail-contacting area and a handle.

4. The standard according to claim 3, wherein said handle is at an angle to said rail-contacting area.

5. A portable rail apparatus for attachment to portable platform panels, said portable rail apparatus for supporting rails and comprising:

a standard;

means for supporting rails including a pair of flanges having a relieved edge that complements the outside diameter of said rails and a band rigidly connected to said flanges, whereby said flanges and said band form a rail receiving space, said means for supporting rails operably connected to said standard:

a clamp means for coupling said standard to said panels, whereby said standard is generally perpendicular relative to said panels, said clamp means including a top and bottom jaw; and an operating means for operating said clamp means, said operating means being carried by said standard, said operating means including:

a movable lever, and a link, said link operably coupled to said lever and said bottom jaw for communicating the movement of said lever to said bottom jaw.

6. The apparatus according to claim 5, wherein said lever and link are aligned generally axially.

7. The apparatus according to claim 5, wherein said top jaw is rigidly fixed to said standard and said bottom jaw is adjustably carried by said link.

8. The apparatus according to claim 7, wherein said panels have a periphery and said bottom jaw carries a tab, said tab projecting at an angle toward said top jaw and providing a locking connection with said periphery.

9. A portable rail apparatus for attachment to portable platform panels, said portable rail apparatus for supporting rails and comprising:

a standard;

means for supporting rails including a pair of flanges having a relieved edge that complements the outside diameter of said rails and a band rigidly connected to said flanges, whereby said flanges and said band form a rail receiving space, said means for supporting rails operably connected to said standard said means for supporting rails including a cam means for pressing said rails against said band;

a clamp means for coupling said standard to said panels, whereby said standard is generally perpendicular relative to said panels, said clamp means including a top and bottom jaw; and an operating means for operating said clamp means, said operating means being carried by said standard.

10. A portable rail apparatus for attachment to portable platform panels, said portable rail apparatus for supporting rails and comprising:

a standard;

means for supporting rails including a pair of flanges having a relieved edge that complements the outside diameter of said rails and a band rigidly connected to said flanges, whereby said flanges and said band form a rail receiving space, said means for supporting rails operably connected to said standard;

a second means for supporting said rails, said second means including a plurality of resilient wafers having a recessed edge that complements the outside dimension of said rails, said second means being attached to said standard;

a clamp means for coupling said standard to said panels, whereby said standard is generally perpendicular relative to said panels, said clamp means including a top and bottom jaw; and an operating means for operating said clamp means, said operating means being carried by said standard.

11. A portable railing apparatus for supporting rails comprising:

a standard having a crown end and a base end;

a bracket assembly operably connected to said crown end of said standard, said bracket assembly including a rail support with recesses complementary to said rails and a band fixedly attached to the rail support whereby said band and rail support enclose rails received in said bracket assembly, said bracket assembly further including a bracket clamp means for holding the rails in place;

a coupling means for coupling said standard to a platform, whereby said standard is generally perpendicular relative to said platform, said coupling means including a movable jaw and a fixed jaw;

an operating means for opening and closing said movable jaw relative to said fixed jaw, said operating means having an open and a closed position; and a link means operably coupled to said operating means and said movable jaw for communicating the movement of said operating means to said movable jaw.

12. The apparatus according to claim 11, wherein said bracket clamp means includes an eccentric rod rotatably supported by said band and extending generally transversely to said rails, whereby turning the eccentric rod presses said rails against said band.

13. The apparatus according to claim 11, wherein said movable jaw has upper and lower apertures complementary to said link means, said link means extending through said upper and lower apertures, and carrying said movable jaw.

14. The apparatus according to claim 13, wherein said link means has an adjustment member for adjusting the distance between said fixed and movable jaws.

15. The apparatus according to claim 11, wherein said operating means is a lever having a free end and a fulcrum end, said lever pivotally coupled to said standard at the fulcrum end of said lever.

16. The apparatus according to claim 15, wherein said lever has a latch hole adjacent said free end, whereby a latch means carried by said standard engages said latch hole when said lever is in the closed position.

17. The apparatus according to claim 11, wherein said apparatus further includes a second means for supporting said side rails, said second means including a plurality of resilient wafers having a relieved area generally complimentary to said rails, said second means attached to said standard between said crown end and said coupling means.

18. A railing system comprising:

a plurality of rails;

a standard having a crown end and a base end;

a bracket assembly for supporting said rails, said bracket assembly operably connected to said crown end and including a rail nest having an arcuate recess complementary to said rails and a band operably connected to said rail nest whereby said rail nest and said band form a rail receiving space, said bracket assembly further including a rail clamp for pressing a rail against said band, said rail clamp comprising an operating rod having at least one rounded cam surface for pressing a rail against said band;

a platform clamp for mounting said standard on a platform of the like, whereby said standard is generally orthogonal relative to said platform, said platform clamp comprising:

a top jaw rigidly attached to said standard proximal to said base end;

a movable bottom jaw including a tab, upper and lower apertures and generally parallel contacting tines, said tab projecting at an angle toward said top jaw;

operating means for operating said platform clamp by moving said bottom jaw toward and away from said top jaw, said operating means comprising:

a lever having a free end and a fulcrum end, said lever pivotally coupled to said standard adjacent said fulcrum end, said free end being movable in a short arc between a closed and an open position, said lever having a latch free hole adjacent said free end, whereby a latch carried by said standard releasably engages said latch hole when said lever is in the closed position; and a link connected to said fulcrum end and to said bottom jaw for communicating movement of said lever to said bottom jaw, said link being generally parallel and closely adjacent to said standard and including an adjustment means for adjusting the distance between said top and bottom jaws without moving said lever.

19. The railing system according to claim 18, wherein said top jaw includes an aperture that receives and guides said jaw link.

20. The railing system according to claim 19, wherein said free end of said lever includes a flared area adjacent said latch hole.

21. The railing system according to claim 18, and a second rail supporting means for supporting rails, said second rail supporting means including resilient wafers each having a recessed surface that complements said rails, said second means being removably attached to said standard.

* * * * *

UNITED STATES PATENT AND TRADEMARK OFFICE

CERTIFICATE OF CORRECTION

PATENT NO. : 5,263,550

DATED : November 23, 1993

INVENTOR(S) : Michael D. Jines et al.

It is certified that error appears in the above-indentified patent and that said Letters Patent is hereby corrected as shown below:

Column 6, line 55, delete the word "surface" and substitute therefor --surfaces--.

Column 8, line 59, delete the number "6" and substitute therefor --7--.

Column 9, line 3, after the word "side", insert --258 of the box frame 252, and a rail length 264 rigidly attached to the second vertical side --.

Signed and Sealed this

Twenty-sixth Day of July, 1994

Bruce Lehman

*Attest:*

BRUCE LEHMAN

*Attesting Officer*

*Commissioner of Patents and Trademarks*